US011155929B2

(12) United States Patent
Koike et al.

(10) Patent No.: US 11,155,929 B2
(45) Date of Patent: Oct. 26, 2021

(54) MASKING JIG AND ELECTROPLATING APPARATUS

(71) Applicant: Showa Corporation, Gyoda (JP)

(72) Inventors: Yuki Koike, Gyoda (JP); Kenji Suzuki, Fukuroi (JP); Masami Kuramochi, Gyoda (JP); Kenji Takahashi, Gyoda (JP)

(73) Assignee: Showa Corporation, Gyoda (JP)

( * ) Notice: Subject to any disclaimer, the term of this patent is extended or adjusted under 35 U.S.C. 154(b) by 172 days.

(21) Appl. No.: 16/673,108

(22) Filed: Nov. 4, 2019

(65) Prior Publication Data

US 2020/0063283 A1 Feb. 27, 2020

Related U.S. Application Data

(63) Continuation-in-part of application No. PCT/JP2017/030167, filed on Aug. 23, 2017.

(30) Foreign Application Priority Data

Jun. 30, 2017 (JP) ..... JP2017-129233

(51) Int. Cl.

| | |
|---|---|
| ***C25D 5/02*** | (2006.01) |
| ***C25D 7/00*** | (2006.01) |
| ***C25D 17/08*** | (2006.01) |
| ***C25D 7/04*** | (2006.01) |

(52) U.S. Cl.

CPC ..... *C25D 5/022* (2013.01); *C25D 7/00* (2013.01); *C25D 7/04* (2013.01); *C25D 17/08* (2013.01)

(58) Field of Classification Search

None

See application file for complete search history.

(56) References Cited

U.S. PATENT DOCUMENTS

| | | | | |
|---|---|---|---|---|
| 6,168,691 | B1 | 1/2001 | Kauper et al. | |
| 6,508,926 | B1 * | 1/2003 | Falkner | C25D 5/022 204/198 |
| 2016/0230300 | A1 * | 8/2016 | Kerner | C25D 7/04 |

FOREIGN PATENT DOCUMENTS

| | | | |
|---|---|---|---|
| JP | 09-013191 | A | 1/1997 |
| JP | 09-078296 | A | 3/1997 |
| JP | 2000-516303 | A | 12/2000 |
| JP | 2008-156685 | A | 7/2008 |

OTHER PUBLICATIONS

International Search Report dated Sep. 26, 2017 for the corresponding PCT International Application No. PCT/JP2017/030167.

* cited by examiner

*Primary Examiner* — Louis J Rufo

(74) *Attorney, Agent, or Firm* — Leason Ellis LLP

(57) ABSTRACT

The masking jig includes a contact member and a support unit. The contact member includes a through-hole allowing for insertion of a rod-like piston rod, and a deformation part around the through-hole configured to get elastically deformed by insertion of a male thread of the piston rod into the through-hole and contact the outer peripheral end face of the piston rod. The support unit supports the contact member such that the contact member moves in a direction intersecting an axial direction of the piston rod.

20 Claims, 11 Drawing Sheets

MASKING JIG AND ELECTROPLATING APPARATUS

CROSS-REFERENCE TO RELATED APPLICATIONS

This application is a continuation-in-part of PCT application No. PCT/JP2017/030167 filed on Aug. 23, 2017, which claims the benefit of priority to Japanese Patent Application No. 2017-129233 filed on Jun. 30, 2017, the contents of both of which are incorporated herein by reference.

FIELD OF THE INVENTION

The present invention relates to a masking jig and an electroplating apparatus.

BACKGROUND OF THE INVENTION

There has been proposed an electroplating apparatus including a masking jig to mask a lower part of a rod-like workpiece (a member to be plated).

For example, Japanese Patent Application Laid-Open Publication No. 09-013191 discloses an electroplating apparatus that immerses a rod-like workpiece suspended by a workpiece support mechanism into a plating tank having an anode and filled with a plating solution. In the plating tank, the electroplating apparatus includes a masking jig to mask a lower part of the workpiece, and the lower part of the workpiece is inserted into the masking jig in the solution and thus masked. To accommodate the lower part of the workpiece, the masking jig includes a recess or a through-hole each having a larger diameter than the outer diameter of the workpiece.

Technical Problem

For example if an axis of the rod-like member to be plated is misaligned with the recess or the through-hole of the masking jig before the member to be plated undergoes plating treatment to form a thin film of a plating substance (metal) on its certain part, a to-be-masked part of the plate member may also be plated (i.e., the thin film may be formed on the to-be-masked part).

The present invention aims to provide a masking jig and an electroplating apparatus each of which can prevent plating of the to-be-masked part.

SUMMARY OF THE INVENTION

Solution to Problem

With this object in view, the present invention is a masking jig including: a contact member including a through-hole and a deformation part around the through-hole, the through-hole allowing for insertion of a rod-like member to be plated, the deformation part being configured to get elastically deformed by insertion of a specific portion of the member to be plated into the through-hole and contact an outer peripheral end face of the member to be plated; and a support part configured to support the contact member such that the contact member moves in a direction intersecting an axial direction of the member to be plated.

From another standpoint, the present invention is an electroplating apparatus including: a plating tank storing a plating solution containing a plating substance; a holding part configured to hold a rod-like member to be plated; and a masking jig placed within the plating tank, the masking jig being configured to mask a specific portion of the member to be plated, wherein the masking jig includes: a contact member including a through-hole and a deformation part around the through-hole, the through-hole allowing for insertion of the member to be plated, the deformation part being configured to get elastically deformed by insertion of the specific portion into the through-hole and contact an outer peripheral end face of the member to be plated; and a support part configured to support the contact member such that the contact member moves in a direction intersecting an axial direction of the member to be plated.

Advantageous Effects of Invention

The present invention allows to align the axis of the member to be plated with the center of the masking jig, preventing plating of the to-be-masked part.

DETAILED DESCRIPTION OF THE INVENTION

Embodiments of the present invention will be described below with reference to the attached drawings.

Figure 1:
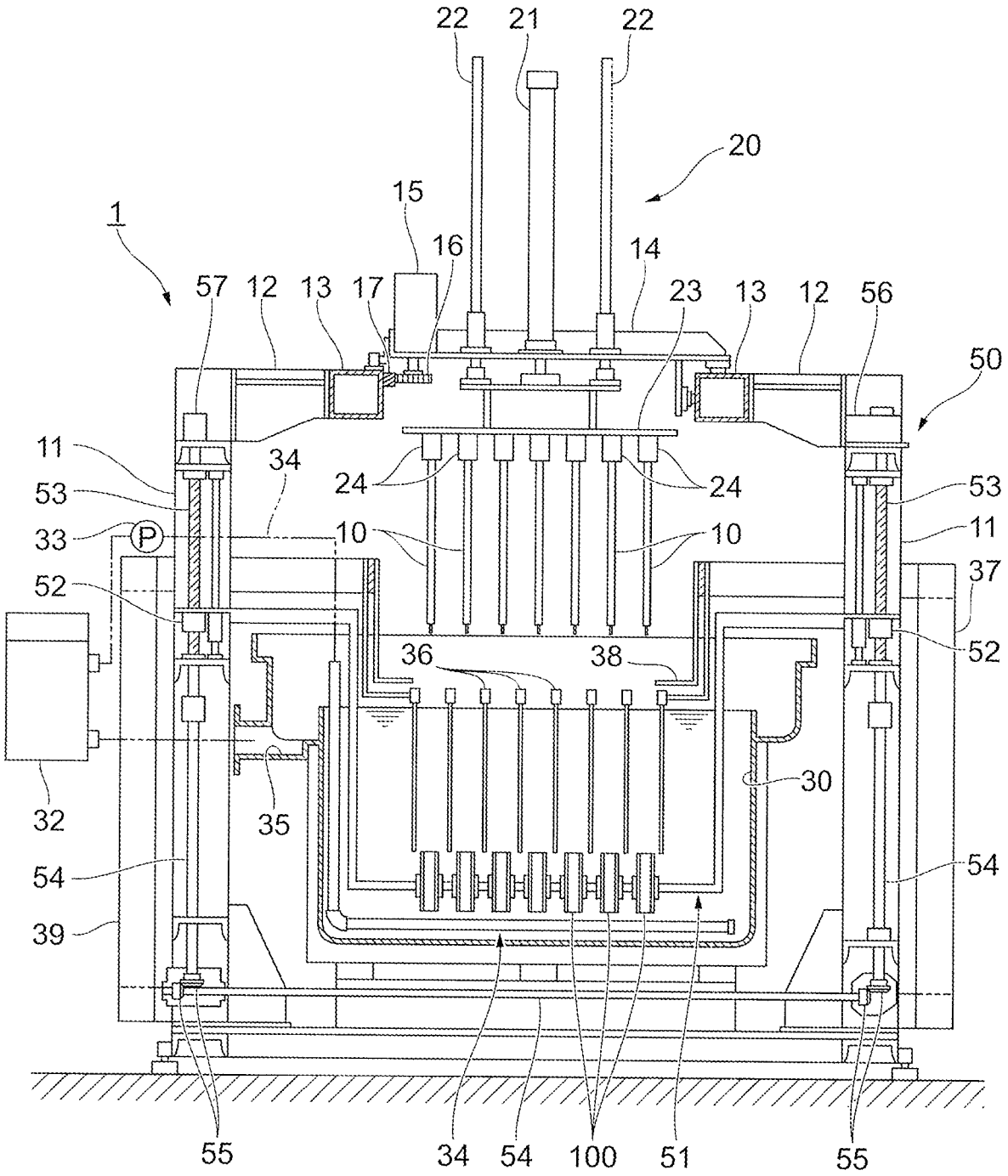
FIG. 1 depicts a schematic configuration of an electroplating apparatus of the embodiments.

FIG. 1 depicts a schematic configuration of an electroplating apparatus 1 of the embodiments.

Figure 2:
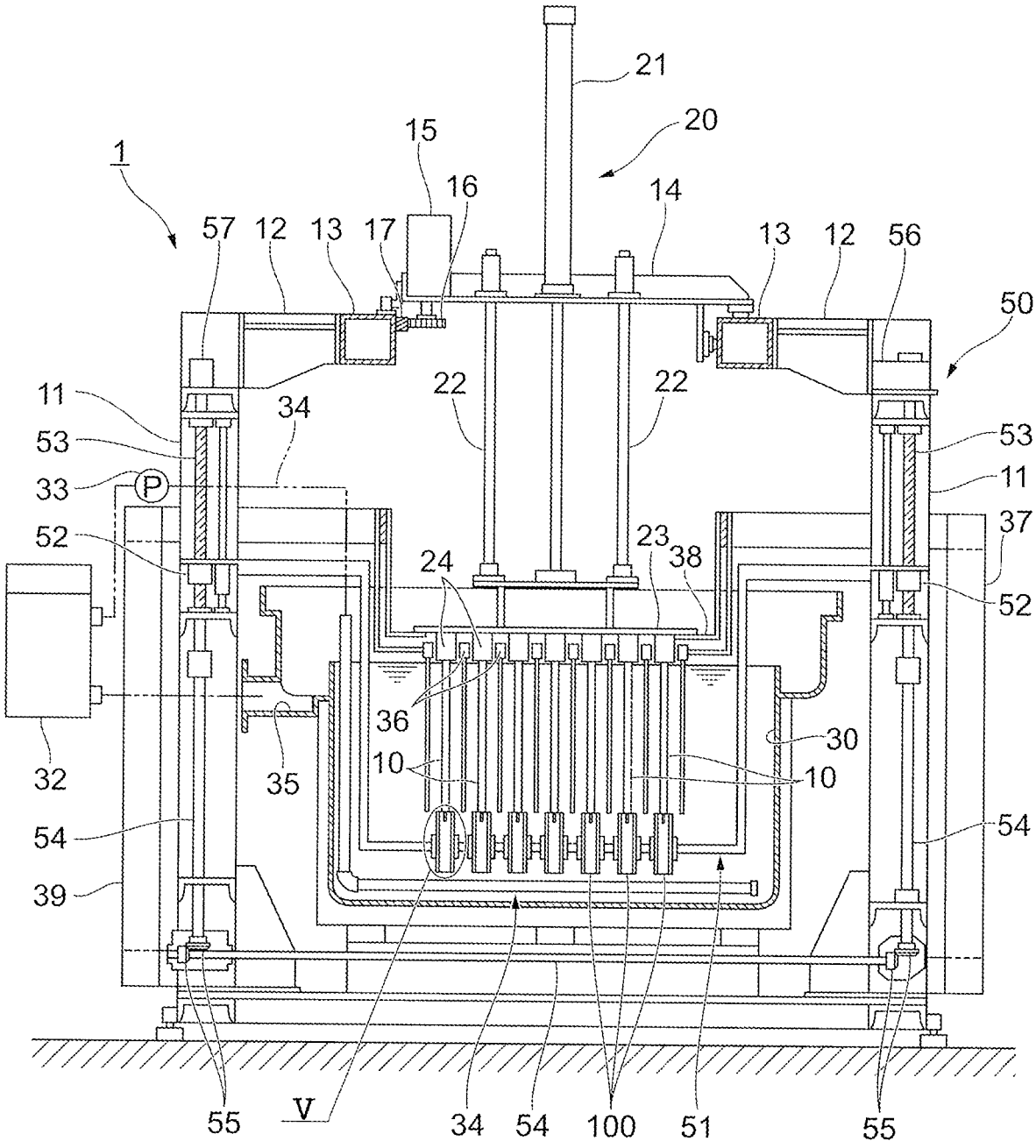
FIG. 2 depicts the electroplating apparatus during plating treatment.

FIG. 2 depicts the electroplating apparatus 1 during plating treatment.

The electroplating apparatus 1 includes a holding mechanism 20 and a plating tank 30. The holding mechanism 20, which is an example of a holding unit, holds a piston rod 10, which is an example of the rod-like member to be plated. The plating tank 30 stores a plating solution containing a plating substance. The electroplating apparatus 1 holds multiple piston rods 10 with the holding mechanism 20, and subjects the multiple piston rods 10 to plating treatment by immersing them in the plating tank 30 located below.

The electroplating apparatus 1 includes: multiple pillars 11 extending in a vertical direction; a horizontal plate 12 laid over the multiple pillars 11; two rails 13 extending in a forward and backward direction (direction perpendicular to the plane of the figure); and a mobile carriage 14 running on the two rails 13.

The electroplating apparatus 1 further includes: a motor 15 mounted on the mobile carriage 14; a pinion 16 attached to an output shaft of the motor 15; and a rack 17 extending in the forward and backward direction and forming a pinion-rack mechanism with the pinion 16. Driving of the motor 15 causes the mobile carriage 14 to move in the forward and backward direction.

The holding mechanism 20 includes: an elevation cylinder 21 moving up and down the piston rods 10; two guides 22 assisting the elevation cylinder 21 in moving up and down the piston rods 10; and an elevation plate 23 attached to lower ends of the elevation cylinder 21 and the two guides 22. The holding mechanism 20 further includes multiple holding sockets 24 attached to the elevation plate 23 and holdings the respective piston rods 10. The multiple holding sockets 24 move up and down with the elevation plate 23 by extension and contraction of the elevation cylinder 21.

The electroplating apparatus 1 further includes: a tank 32 storing a plating solution; a pump 33; a supply pipe 34 to supply the plating solution stored in the tank 32 to the plating tank 30; and a return pipe 35 to return the plating solution in the plating tank 30 to the tank 32.

The electroplating apparatus 1 further includes: an anode 36 for electroplating; an anode-side bus bar 37; a cathode receiver 38; and a cathode-side bus bar 39.

The electroplating apparatus 1 further includes: a masking jig 100 disposed in the plating tank 30 to mask particular parts of the piston rods 10; and an elevation mechanism 50 holding the masking jig 100 and moving up and down with the masking jig 100.

The masking jig 100 will be described in detail later.

The elevation mechanism 50 includes: a substantially U-shaped frame 51 holding the masking jig 100; multiple nut members 52 supporting both ends of the frame 51; screws 53 moving up and down the respective nut members 52; and a transmission rod 54 and bevel gears 55 to rotate the screws 53. The elevation mechanism 50 further includes a motor 56 coupled with one of the screws 53, and a rotation detector 57 coupled with the other of the screws 53.

The above configured electroplating apparatus 1 has the capability to adjust the height of the masking jig 100 according to the length of members to undergo the plating treatment (the piston rods 10 in the present embodiments) or parts to be masked. The motor 15 is driven to move the members to be plated (the piston rods 10) to a position above the plating tank 30, and then the elevation cylinder 21 is driven to move down the members to be plated from that position. The elevation plate 23 is thus placed on the cathode receiver 38. Then, a predetermined voltage is applied between the anode 36 and the members to be plated (the piston rods 10) via the anode-side bus bar 37 and the cathode-side bus bar 39. This causes metal ion (e.g., Cr ion), which is an example of the plating substance in the plating solution, to move toward the members to be plated (the piston rods 10) on the cathode side, resulting in the metal being deposited by reduction.

(Piston Rod and Masking Jig)

Figure 3:
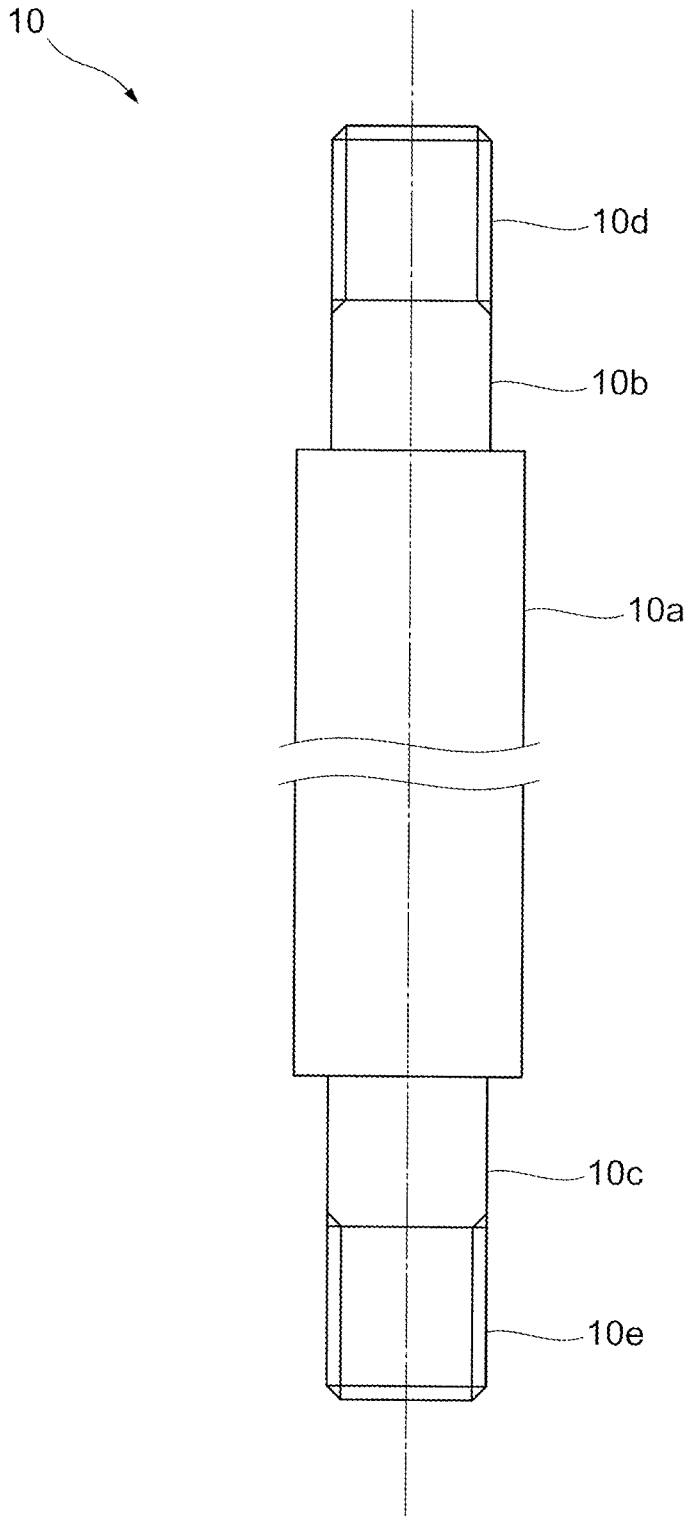
FIG. 3 is a schematic view of a piston rod as an example of the member to be plated.

FIG. 3 is a schematic view of the piston rod 10 as an example of the member to be plated. The figure illustrates the piston rod 10 in the same orientation as FIG. 1.

Figure 4A:
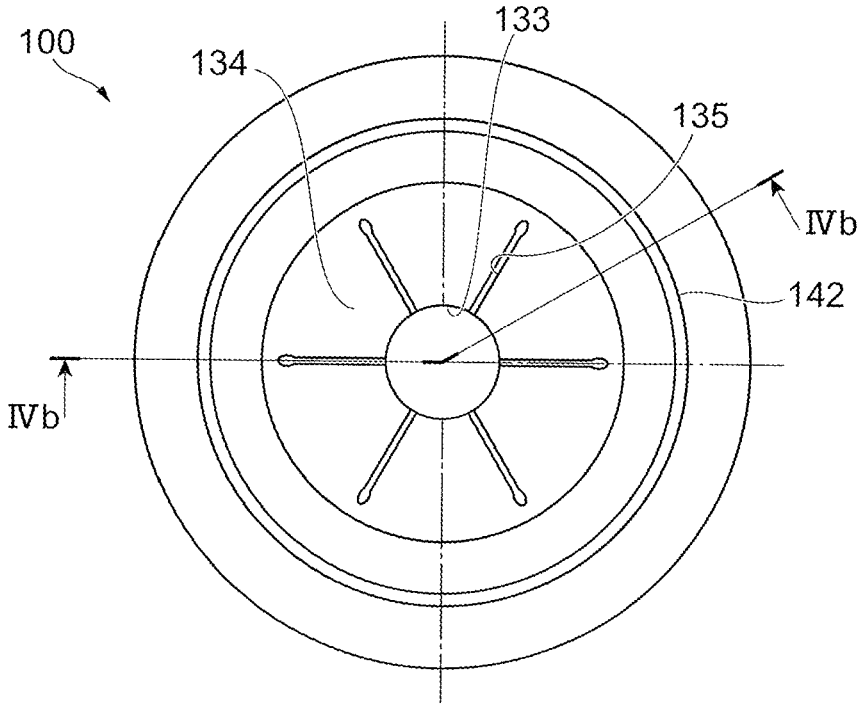
FIGS. 4A and 4B depict a schematic configuration of a masking jig of the first embodiment.
Figure 4B:
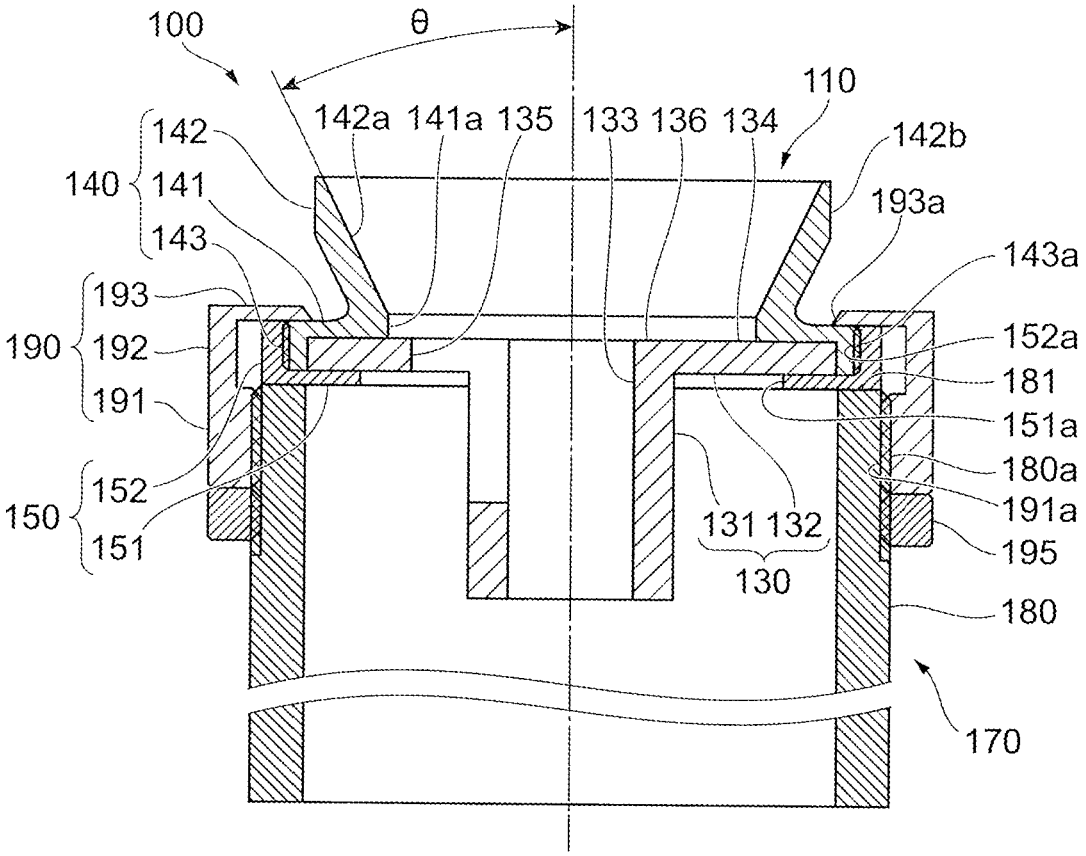

FIGS. 4A and 4B depict a schematic configuration of the masking jig 100 of the first embodiment. The masking jig 100 is preferable for subjecting the piston rod 10 to plating treatment.

(Piston Rod)

The piston rod 10 is a component used for suspension of a vehicle. The piston rod 10 holds, at one end thereof, a piston located within a cylinder. The other end of the piston rod 10 exposes to the outside of the cylinder. For example to avoid the situation where the part of the piston rod 10 exposed to the outside of the cylinder is worn by sliding contact with an oil seal to seal the cylinder, hard chromium plating is performed on that part in sliding contact with the oil seal.

The piston rod 10 consists of multiple columnar parts each having a different outer diameter, namely a central shaft part 10*a* with the largest outer diameter, an upper shaft part 10*b* above the central shaft part 10*a*, and a lower shaft part 10*c* below the central shaft part 10*a*. A male thread 10*d* is formed on the outer periphery at the upper end of the upper shaft part 10*b*, and a male thread 10*e* is formed on the outer periphery at the lower end of the lower shaft part 10*c*. The central shaft part 10*a* contacts the oil seal, meaning that the central shaft part 10*a* is a part to be plated by the electroplating apparatus 1 (i.e., the part on which a metal thin film is to be formed). The male threads 10*d*, 10*e* are the parts to be fastened with nuts, and thus they are not to be plated (i.e., no metal thin film is formed on them). The upper shaft part 10*b* is held by the holding socket 24 of the holding mechanism 20, and the male thread 10*e* is masked by the masking jig 100.

(Masking Jig)

First Embodiment

The masking jig 100 of the first embodiment includes a prevention unit 110 and a support unit 170. The prevention unit 110 prevents metal ion, which is an example of the plating substance, from moving toward the male thread 10*e*, which is an example of the specific part of the rod-like piston rod 10. As an example of the support part, the support unit 170 supports the prevention unit 110 such that the prevention unit 110 can move in a direction intersecting the axis of the piston rod 10.

[Prevention Unit]

The prevention unit 110 includes a contact member 130 that contacts the outer periphery of the lower shaft part 10*c* of the piston rod 10 to thereby prevent the metal ion from moving toward the male thread 10*e*. The prevention unit 110 further includes a prevention member 140 that surrounds the lower end of the central shaft part 10*a*, which is located above the male thread 10*e* of the piston rod 10, to thereby prevent the metal ion from moving toward the male thread 10*e*. The prevention unit 110 further includes a holding member 150 that holds the contact member 120 and the prevention member 140.

The contact member 130 includes a cylindrical part 131 surrounding the lower shaft part 10*c* (the male thread 10*e*) of the piston rod 10, and a flange 132 at the upper end of the cylindrical part 131. The contact member 130 is an elastic body, such as rubber. For example, the contact member 130 is molded of thermoplastic fluoropolymer, such as polyvinylidene fluoride (PVDF).

The inner diameter of the cylindrical part 131 is equal to the outer diameter of the lower shaft part 10*c* of the piston rod 10. The length of the cylindrical part 131 in the centerline direction is longer than that of the lower shaft part 10*c* of the piston rod 10. Accordingly, the lower shaft part 10*c* of the piston rod 10 is situated inside the contact member 130. The inside of the cylindrical part 131 of the contact member 130 functions as a through-hole 133 that allows for insertion of the lower shaft part 10*c* of the piston rod 10.

Around the through-hole 133 allowing for insertion of the lower shaft part 10*c* of the piston rod 10, the contact member 130 includes a deformation part 134. The deformation part 134 is elastically deformed by insertion of the male thread 10*e* into the through-hole 133 and contacts the outer peripheral end face of the piston rod 10. The deformation part 134 consists of upper and middle sections of the cylindrical part 131 and a central section of the flange 132. The deformation part 134 includes radial slits 135 dividing the deformation part 134 into multiple sections. That is, the contact member 130 includes multiple separate contact pieces 136, and the slits 135 are formed so that the contact pieces 136 do not contact each other in a state where the lower shaft part 10*c* of the piston rod 10 is not inserted.

In the masking jig 100, the centerline direction of the cylindrical parts and members including the cylindrical part 131 coincides with the axial direction of the piston rod 10.

The prevention member 140 includes: a round and planar base part 141 including a through-hole 141*a* at the center thereof; an inclined part 142 extending upward from the inner peripheral end of the base part 141 in a direction obliquely intersecting the axial direction; and a cylindrical part 143 extending downward in the axial direction from the outer peripheral end of the base part 141.

The hole diameter of the through-hole 141*a* of the base part 141 is larger than the outer diameter of the central shaft part 10*a* of the piston rod 10. The outer diameter of the base part 141 is larger than the outer diameter of the contact member 130.

The inclined part 142 is formed such that a distance between an inner surface 142*a* and an outer surface of the central shaft part 10*a* of the piston rod 10 gradually narrows from the top to the bottom. In other words, the inclined part 142 is inclined relative to the axis such that a distance between the inclined part 142 and the central shaft part 10*a*, which is an example of the specific portion, gradually narrows toward the contact member 130. For example, the inclination angle θ of the inclined part 142 relative to the axis is less than 45 degrees. An upper outer surface 142*b* of the inclined part 142 has a constant outer diameter along a predetermined length so that the upper outer surface 142*b* is parallel to the axis. A lower outer surface of the inclined part 142 below the upper outer surface 142*b* is molded to have an outer diameter gradually narrowing from the top to the bottom, in such a manner to ensure that the wall thickness of the lower outer surface remains substantially constant.

The inner diameter of the cylindrical part 143 is larger than the outer diameter of the flange 132 of the contact member 130, and the size of the cylindrical part 143 in the axial direction is larger than that of the flange 132 of the contact member 130. The cylindrical part 143 includes on its outer surface a male thread 143*a* that is fastened to a female thread 152*a* of the holding member 150.

The prevention member 140 is made of metal or resin, for example.

The holding member 150 includes a round and planar disk part 151 having a through-hole 151*a* at the center thereof, and a cylindrical part 152 extending upward in the axial direction from the outer peripheral end of the disk part 151.

The hole diameter of the through-hole 151*a* of the disk part 151 is larger than the outer diameter of the cylindrical part 131 of the contact member 130, and smaller than the outer diameter of the flange 132 of the contact member 130.

the outer diameter of the disk part 151 is larger than that of the flange 132 of the contact member 130.

The cylindrical part 152 includes on its inner surface the female thread 152*a* fastened to the male thread 143*a* on the outer surface of the cylindrical part 143 of the prevention member 140.

The holding member 150 is made of metal or resin, for example.

With the contact member 130 interposed between the disk part 151 of the holding member 150 and the base part 141 of the prevention member 140, the male thread 143*a* of the prevention member 140 is fastened to the female thread 152*a* of the holding member 150. These components are thus integrated to form the above configured prevention unit 110.

[Support Unit]

The support unit 170 includes: a base 180 on which the prevention unit 110 rests; a restricting member 190 to restrict movement of the prevention unit 110 in the axial direction by holding the prevention unit 110 between the base 180 and the restricting member 190; and a lock nut 195 to restrict movement of the restricting member 190.

The base 180 is a cylindrical member and includes an upper end face 181 perpendicular to the axial direction. The inner diameter of the base 180 is larger than the outer diameter of the cylindrical part 131 of the surrounding member 130 of the prevention unit 110, and the length of the base 180 in the axial direction is longer than that of the cylindrical part 131 of the surrounding member 130. The outer diameter of the base 180 is equal to or larger than the outer diameter of the holding member 150 of the prevention unit 110. On an upper outer surface of the base 180, there is a male thread 180*a* fastened to a female thread 191*a* of the restricting member 190.

The base 180 is made of metal or resin, for example.

The restricting member 190 includes two cylindrical parts having the same outer diameter and different inner diameters, namely a first cylindrical part 191 and a second cylindrical part 192, and a protrusion 193 protruding from the upper end of the second cylindrical part 192 to the inside (to the center).

The restricting member 190 is made of metal or resin, for example.

The first cylindrical part 191 includes on its inner surface the female thread 191*a* fastened to the male thread 180*a* on the outer surface of the base 180.

The inner diameter of the second cylindrical part 192 is larger than that of the first cylindrical part 191. The size of the second cylindrical part 192 in the axial direction is larger than that of the holding member 150 of the prevention unit 110.

The protrusion 193 is a round and planar part including a through-hole 193*a* at the center thereof. The hole diameter of the through-hole 193*a* is smaller than the inner diameter of the cylindrical part 143 of the prevention member 140 of the prevention unit 110. The hole diameter of the through-hole 193*a* is larger than the outer diameter of the upper outer surface 142*b*, which is the largest outer diameter in the inclined part 142 of the prevention member 140.

With the above configuration of the support unit 170, the lower end face of the holding member 150 of the prevention unit 110 (the bottom face of the disk part 151) is placed on the upper end face 181 of the base 180, and in that state the restricting member 190 is fitted to the base 180. At this time, the inclined part 142 of the prevention member 140 of the prevention unit 110 is passed through the through-hole 193*a* of the protrusion 193 of the restricting member 190. Then, the female thread 191*a* of the restricting member 190 is fastened to the male thread 180*a* of the base 180 to movably support the prevention unit 110. Downward movement of the restricting member 190 is restricted by the lock nut 195 fastened to the male thread 180*a* of the base 180. The lock nut 195 is positioned such that a gap between the upper end face 181 of the base 180 and the protrusion 193 of the restricting member 190 is larger than the size of the prevention unit 110, which is to be held between the upper end face 181 of the base 180 and the protrusion 193 of the restricting member 190.

The inner diameter of the second cylindrical part 192 of the restricting member 190 is larger than the inner diameter of the first cylindrical part 191, and also larger than the outer diameter of the holding member 150 of the prevention unit 110. This forms a gap between the inner surface of the second cylindrical part 192 and the outer surface of the holding member 150 of the prevention unit 110. This means that the prevention unit 110 can move in the direction perpendicular to the axial direction until the outer surface of the holding member 150 contacts the inner surface of the second cylindrical part 192 of the restricting member 190.

Figure 5:
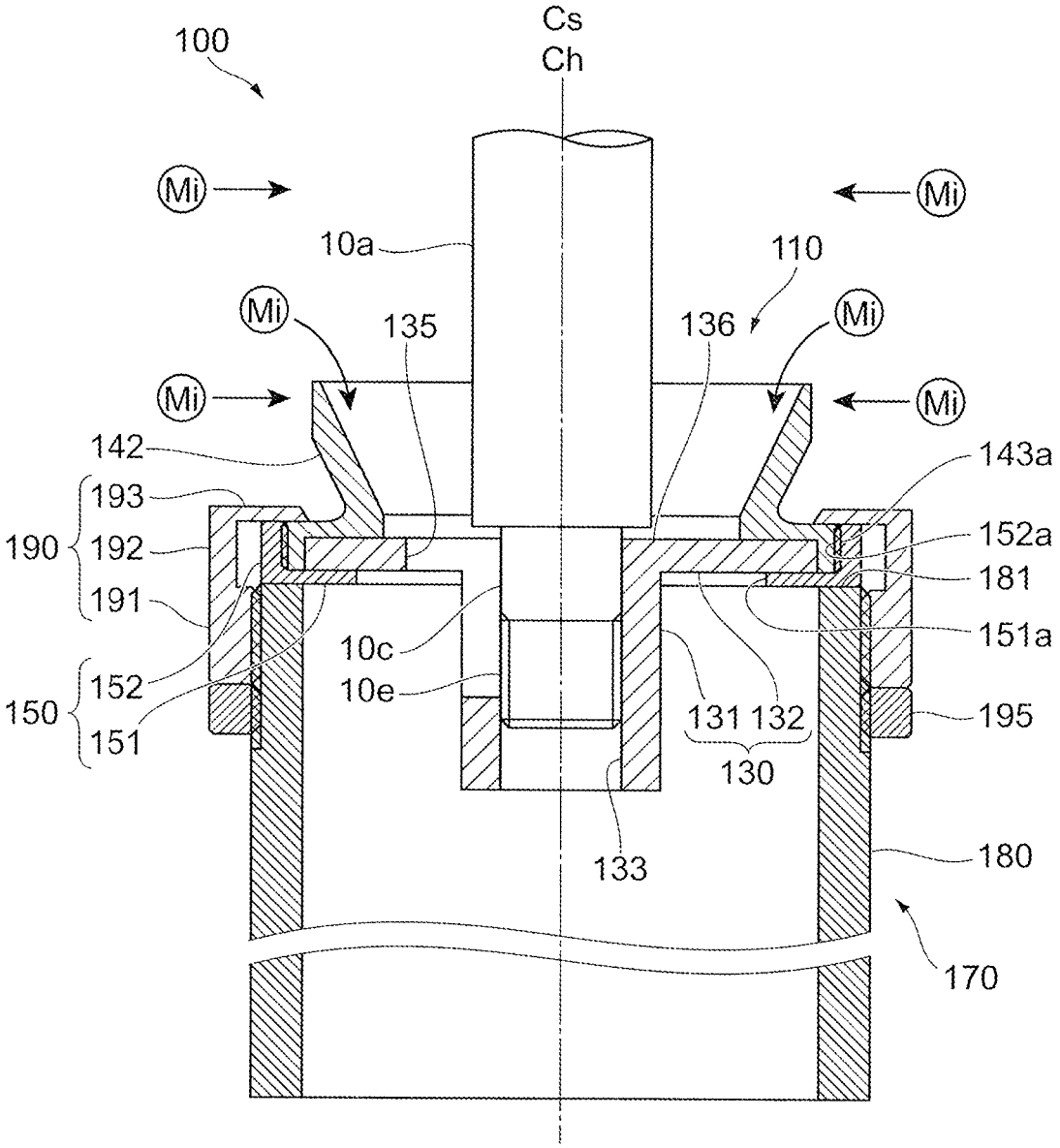
FIG. 5 depicts the masking jig of the first embodiment when a piston rod is inserted in it.

FIG. 5 depicts the masking jig 100 of the first embodiment when the piston rod 10 is inserted in it. That is, FIG. 5 is also an enlarged cross-sectional view of the part V in FIG. 2.

In the electroplating apparatus 1, when a predetermined voltage is applied between the anode 36 and the piston rod 10 via the anode-side bus bar 37 and the cathode-side bus bar 39, the metal ion Mi in the plating solution moves toward the piston rod 10 on the cathode side, resulting in the metal being deposited by reduction.

Meanwhile, the gap between the inner surface 142*a* of the inclined part 142 of the prevention member 140 and the outer surface of the central shaft part 10*a* of the piston rod 10 gradually narrows from the top to the bottom. For this reason, the amount of metal ion Mi reaching the outer surface of the central shaft part 10*a* gradually reduces toward the lowest end of the central shaft part 10*a*. Also, the inner diameter of the cylindrical part 131 of the contact member 130 of the prevention unit 110 (the hole diameter of the through-hole 133) is equal to the outer diameter of the lower shaft part 10*c* of the piston rod 10. Accordingly, when the lower shaft part 10*c* of the piston rod 10 is inserted in the through-hole 133, the inner surface of the cylindrical part 131 of the contact member 130 is in contact with the outer surface of the lower shaft part 10*c* of the piston rod 10. This allows the contact member 130 to block the metal ion Mi from moving toward the male thread 10*e* by going through the inner surface of the cylindrical part 131 of the contact member 130 and the outer surface of the lower shaft part 10*c* from above the contact member 130. Moreover, the cylindrical part 131 of the contact member 130 surrounds the male thread 10*e*. This prevents the metal ion Mi from moving toward the male thread 10*e* through between the outer surface of the cylindrical part 131, which is the outer side of the cylindrical part 131, and the inner surface of the base 180. These can prevent formation of a metal thin film (reductive deposition of metal) on the male thread 10*e* of the piston rod 10.

When the center Ch of the through-hole 133 of the contact member 130 coincides with the axis Cs of the piston rod 10 (the lower shaft part 10*c*) at the time of insertion of the piston rod 10 into the masking jig 100, the inner surface of the cylindrical part 131 evenly contacts the outer surface of the lower shaft part 10*c* of the piston rod 10.

Figure 6A:
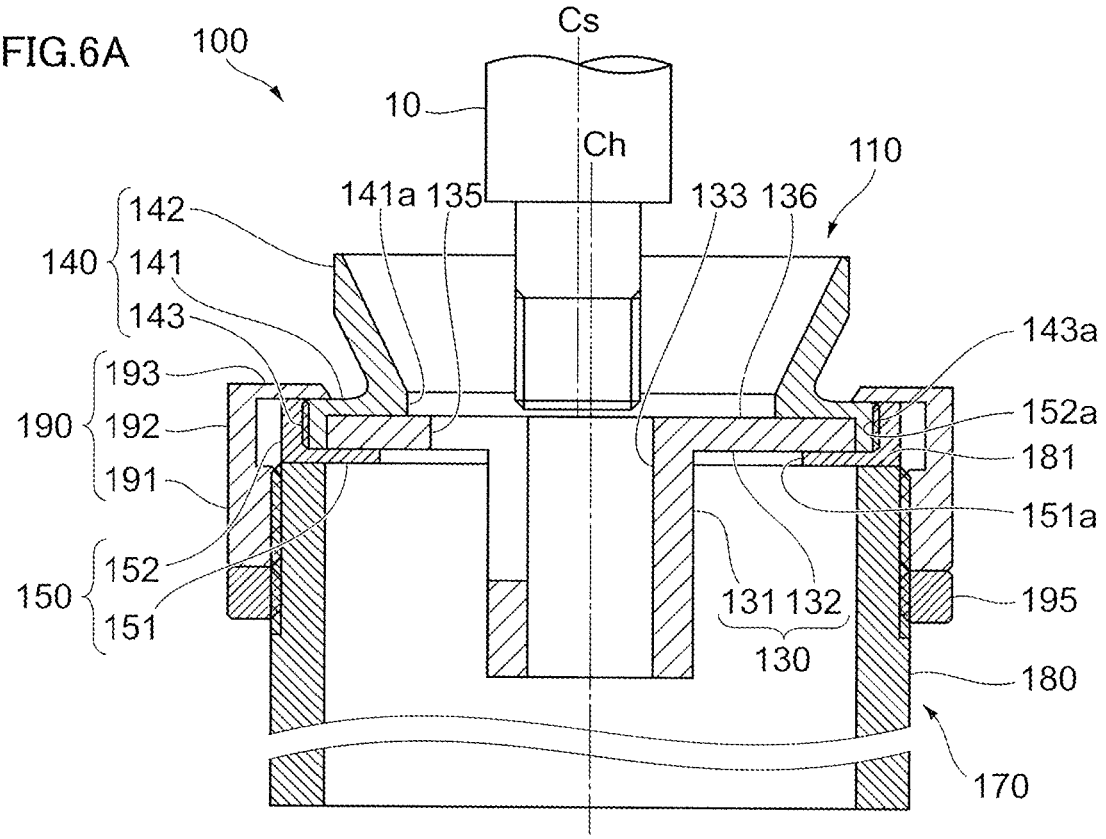
FIG. 6A depicts the masking jig of the first embodiment before the piston rod is inserted in it.
Figure 6B:
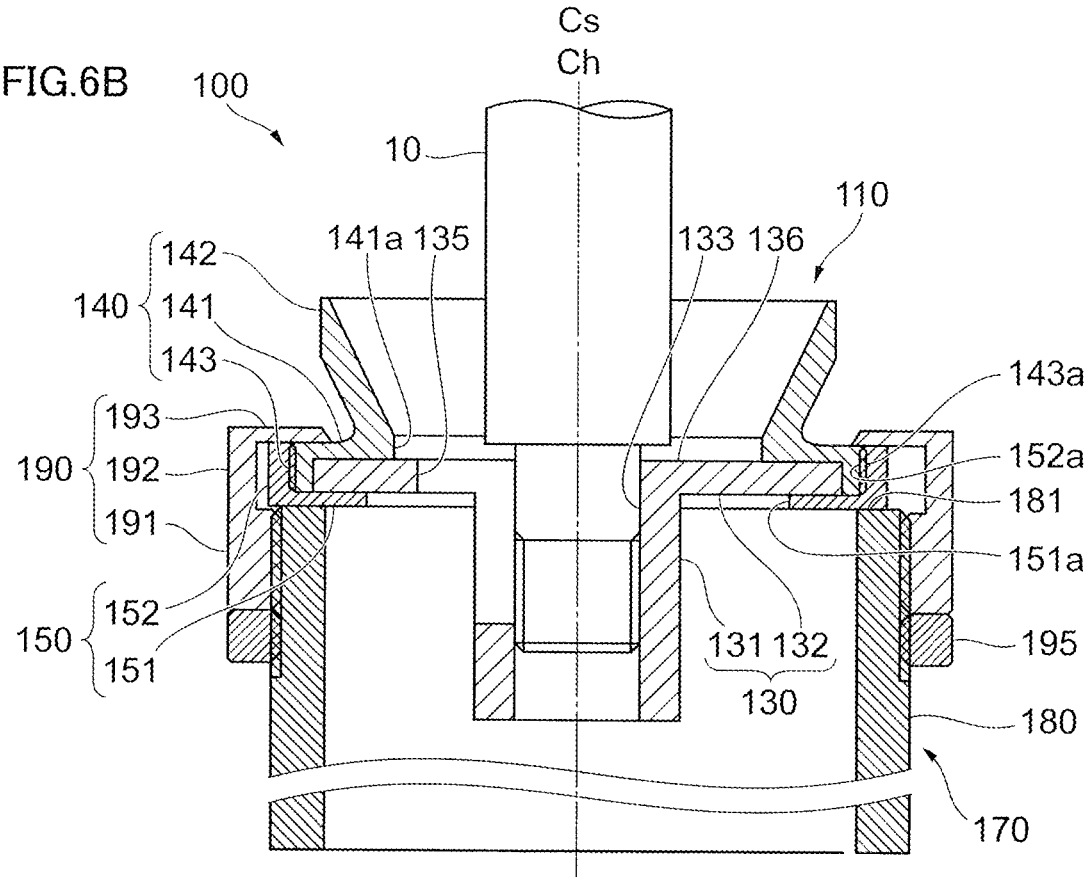
FIG. 6B depicts the masking jig of the first embodiment when the piston rod is inserted in it.

FIG. 6A depicts the masking jig 100 of the first embodiment before the piston rod 10 is inserted in it. FIG. 6B depicts the masking jig 100 of the first embodiment when the piston rod 10 is inserted in it.

As shown in FIG. 6A, when the center Ch of the through-hole 133 of the contact member 130 and the axis Cs of the piston rod 10 (the lower shaft part 10*c*) are offset from each other at the time of insertion of the piston rod 10 into the masking jig 100, the outer surface of the lower shaft part 10*c* contacts top faces of only some of the multiple contact pieces 136, and these contact pieces 136 contacted by the lower shaft part 10*c* receive force in the direction perpendicular to the axial direction. This causes the prevention unit 110 to move in the direction in which these contact pieces 136 receive force from the lower shaft part 10*c*, allowing for easy alignment of the center Ch of the through-hole 133 and the axis Cs of the piston rod 10. Thus, upon insertion of the piston rod 10 in the masking jig 100, the multiple contact pieces 136 evenly contact the outer surface of the lower shaft part 10*c*.

By virtue of the multiple contact pieces 136 evenly contacting the outer peripheral end face of the lower shaft part 10*c*, it is possible to more reliably prevent the metal ion Mi from moving toward the male thread 10*e* by going through between the inner surface of the cylindrical part 131 and the outer surface of the lower shaft part 10*c* from above the contact member 130.

Figure 7A:
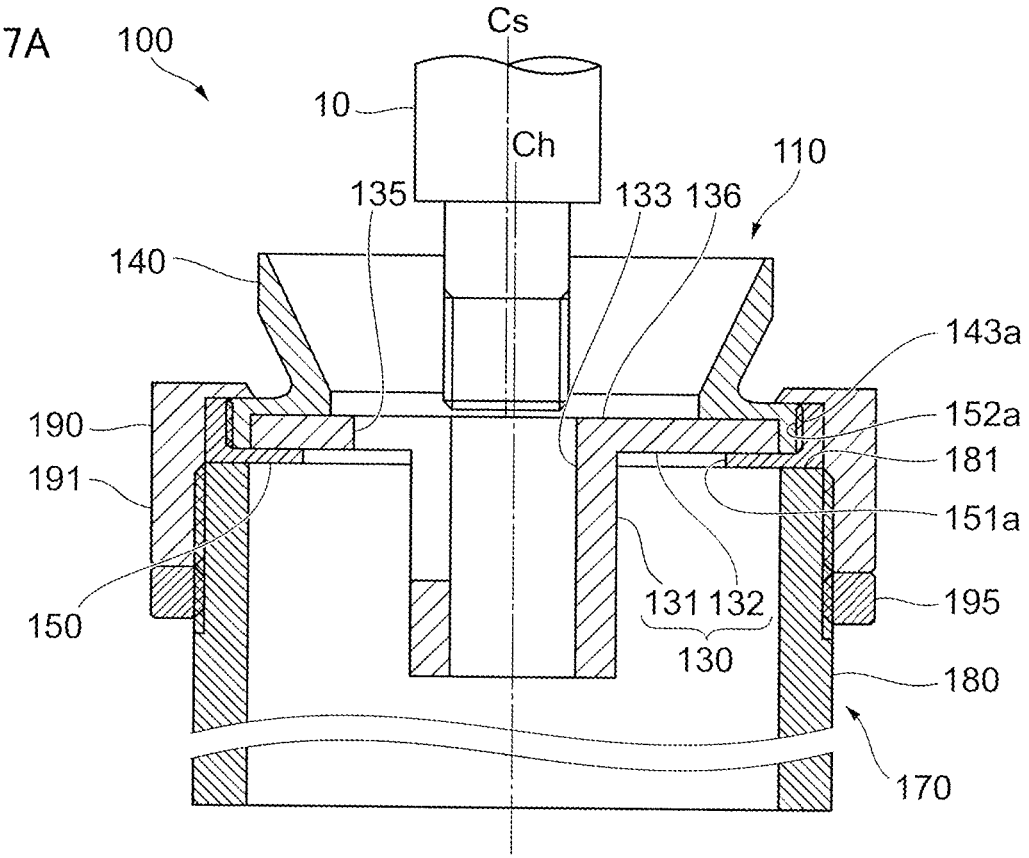
FIG. 7A depicts a masking jig of a comparative example before the piston rod is inserted into it.
Figure 7B:
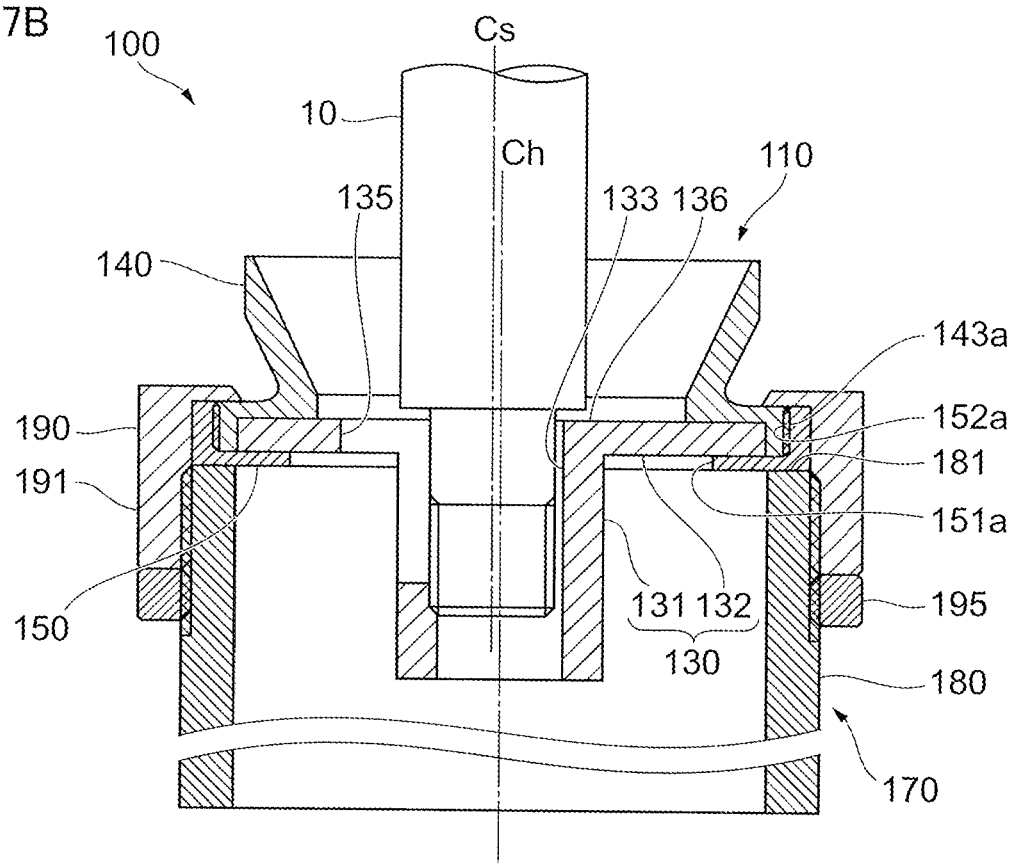
FIG. 7B depicts the masking jig of the comparative example when the piston rod is inserted in it.

FIG. 7A depicts a masking jig of a comparative example before the piston rod is inserted into it. FIG. 7B depicts the masking jig of the comparative example when the piston rod is inserted in it.

The masking jig of the comparative example is different from the masking jig 100 of the first embodiment in that the contact member 130 of the comparative example is not movable in the direction perpendicular to the axis.

When the center Ch of the through-hole 133 of the contact member 130 and the axis Cs of the piston rod 10 (the lower shaft part 10*c*) are offset from each other at the time of insertion of the piston rod 10 into the masking jig 100, the outer surface of the lower shaft part 10*c* contacts top faces of only some of the multiple contact pieces 136. The piston rod 10 then moves downward while elastically deforming these some contact pieces 136. As a result, upon insertion of the piston rod 10 in the masking jig of the comparative example, a gap is formed between the outer surface of the lower shaft part 10*c* and other contact pieces 136 that have not been contacted by the outer surface of the lower shaft part 10*c*. This gap may let the metal ion Mi move toward the male thread 10*e* from above the contact member 130, which may result in the male thread 10*e* being plated (a metal thin film may be plated on the male thread 10*e*). Further, if only some of the contact pieces 136 are repeatedly deformed due to misalignment between the center Ch of the through-hole 133 and the axis Cs of the piston rod 10 (the lower shaft part 10*c*), it may cause damages to the masking jig, such as plastic deformation of these some contact pieces 136, leading to a reduced durability of the masking jig.

In contrast, the masking jig 100 of the first embodiment allows for easy alignment of the center Ch of the through-hole 133 of the contact member 130 with the axis Cs of the piston rod 10 (the lower shaft part 10*c*) even when the center Ch of the through-hole 133 and the axis Cs of the piston rod 10 are offset from each other. That is, the prevention unit 110 is supported so as to be movable relative to the support unit 170, and this allows for easy alignment of the center Ch of the through-hole 133 with the axis Cs of the piston rod 10 after insertion of the piston rod 10, even when the center Ch of the through-hole 133 and the axis Cs of the piston rod 10 are offset from each other at the time of insertion of the piston rod 10. As a result, after insertion of the piston rod 10 in the masking jig 100, the multiple contact pieces 136 evenly contact the outer surface of the lower shaft part 10*c*, and this more reliably prevents the metal ion Mi from moving toward the male thread 10*e* from above the contact member 130. Hence the masking jig 100 of the first embodiment more reliably prevents plating (formation of a metal thin film) on the to-be-masked part.

In the masking jig 100 of the first embodiment, the inclined part 142 of the prevention member 140 of the prevention unit 110 is inclined such that the gap between the inclined part 142 and the central shaft part 10*a* gradually narrows toward the contact member 130, and the inclination angle θ relative to the axial direction is less than 45 degrees. The masking jig 100 of the first embodiment thus ensures that the metal ion Mi hardly moves toward the male thread 10*e* from above the contact member 130, as compared to when the inclination angle θ of the inclined part 142 relative to the axial direction is 45 degrees or more. Hence the masking jig 100 of the first embodiment can more reliably prevent plating on the to-be-masked part.

A smaller angle θ means a lower possibility of the metal ion Mi reaching the lower end of the central shaft part 10*a*, which may result in a failure to form a metal thin film on the lower end of the central shaft part 10*a*. A larger axial length of the inclined part 142 means a lower possibility of the metal ion Mi reaching the lower end of the central shaft part 10*a*. A smaller difference between the diameter of the inner surface of the inclined part 142 and the diameter of the outer surface of the central shaft part 10*a* also means a lower possibility of the metal ion Mi reaching the lower end of the central shaft part 10*a*. In view of this, the angle θ, the axial length of the inclined part 142, and the difference between the diameters of the inner surface of the inclined part 142 and the outer surface of the central shaft part 10*a* may be set in correlation to each other, such as shortening the axial length of the inclined part 142 with decrease in the angle θ.

In the masking jig 100 of the first embodiment, the slits 135 are formed on the contact member 130, so that the multiple separate contact pieces 136 do not contact each other in the state where the lower shaft part 10*c* of the piston rod 10 is not inserted. If, on the contrary, the multiple contact pieces 136 are in contact with each other before insertion of the lower shaft part 10*c* of the piston rod 10, the contact pieces 136 may butt against each other as a result of insertion of the lower shaft part 10*c*. This may cause the contact pieces 136 to contact the central shaft part 10*a*. Such contact of the contact pieces 136 with the central shaft part 10*a* leads to a failure to form a metal thin film on the lower end of the central shaft part 10*a*. As explained above, use of the masking jig 100 of the first embodiment can reliably avoid a failure to plate the part to be plated.

In the masking jig 100 of the first embodiment, the upper outer surface 142*b* of the inclined part 142 of the prevention member 140 of the prevention unit 110 is molded parallel to the axial direction. Also, the size of the inclined part 142 of the prevention member 140 in the direction perpendicular to the axial direction is smaller than that of the base 180 of the support unit 170. As such, the upper outer surface 142*b* of the inclined part 142 of the prevention member 140 is limited in size in the direction perpendicular to the axial direction. This ensures that the upper outer surface 142*b* of the inclined part 142 of the prevention member 140 hardly interferes with the anode 36 (see FIG. 1) when the masking jig 100 is installed in the electroplating apparatus 1. That is, with the inclined part 142 of the prevention member 140 having the aforementioned shape, the masking jig 100 of the first embodiment helps to improve space efficiency in the electroplating apparatus 1.

In the above embodiment, the inner diameter of the cylindrical part 131 of the contact member 130 of the prevention unit 110 (the hole diameter of the through-hole 133) is equal to the outer diameter of the lower shaft part 10*c* of the piston rod 10. The present invention is, however, not limited to this embodiment. The inner diameter of the cylindrical part 131 of the contact member 130 may be different from the outer diameter of the lower shaft part 10*c* of the piston rod 10. For example, the inner diameter of the cylindrical part 131 of the contact member 130 may be smaller than the outer diameter of the lower shaft part 10*c* of the piston rod 10. In that case, the contact pieces 136 of the contact member 130 are elastically deformed when the lower shaft part 10*c* of the piston rod 10 is inserted into the through-hole 133, and with the lower shaft part 10*c* being inserted in the through-hole 133, the inner surface of the cylindrical part 131 contacts the outer surface of the lower shaft part 10*c*.

The inner diameter of the cylindrical part 131 of the contact member 130 may be larger than the outer diameter of the lower shaft part 10*c* of the piston rod 10. In that case, namely when there is a gap between the inner surface of the cylindrical part 131 of the contact member 130 and the outer surface of the lower shaft part 10*c* of the piston rod 10, the inner diameter of the cylindrical part 131 of the contact member 130 and the outer diameter of the lower shaft part 10*c* may be set as follows. When there is a long axial length from the upper end face of the contact member 130 to the male thread 10*e* of the lower shaft part 10*c* of the piston rod 10 inserted in the through-hole 133 of the contact member 130, the metal ion Mi hardly reaches the male thread 10*e* even with the presence of a gap between the inner surface of the cylindrical part 131 of the contact member 130 and the outer surface of the lower shaft part 10*c* of the piston rod 10. As such, the position of the male thread 10*e* and the size of the gap may be set in correlation to each other so as to prevent the metal ion Mi from reaching the male thread 10*e*, such as permitting a greater gap between the inner surface of the cylindrical part 131 and the outer surface of the lower shaft part 10*c* of the piston rod 10 with increase in the axial length from the upper end face of the contact member 130 to the male thread 10*e* of the lower shaft part 10*c*.

Alternatively, besides making the inner diameter of the cylindrical part 131 of the contact member 130 larger than the outer diameter of the lower shaft part 10*c* of the piston rod 10, their axial positions may be defined such that the lower end face of the central shaft part 10*a* of the piston rod 10 abuts and pushes the upper end face of the contact member 130. As a result of the lower end face of the central shaft part 10*a* of the piston rod 10 pushing the upper end face of the contact member 130, the contact pieces 136 are elastically deformed to protrude to the inside (to the outer surface of the lower shaft part 10*c*), narrowing the gap between the inner surface of the cylindrical part 131 and the outer surface of the lower shaft part 10*c*. This ensures that the metal ion Mi hardly reaches the male thread 10*e*, even with the presence of the gap between the inner surface of the cylindrical part 131 of the contact member 130 and the outer surface of the lower shaft part 10*c* of the piston rod 10.

Second Embodiment

Figure 8:
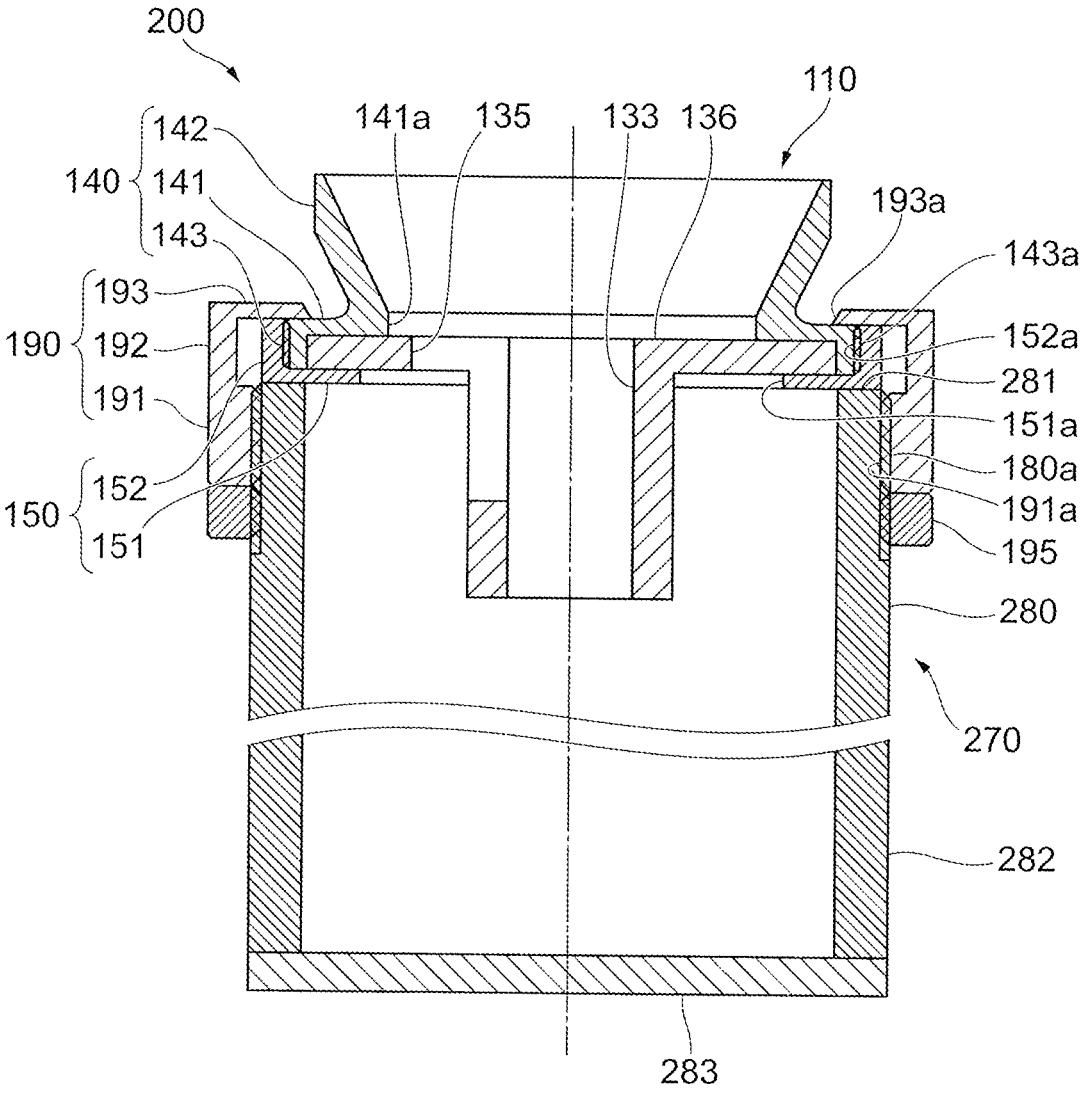
FIG. 8 depicts a schematic configuration of a masking jig of the second embodiment.

FIG. 8 depicts a schematic configuration of a masking jig 200 of the second embodiment.

The masking jig 200 of the second embodiment is different from the masking jig 100 of the first embodiment in that a base 280 of a support unit 270 of the masking jig 200 includes, on its bottom, a blocking part 283 that blocks the metal ion Mi from moving to the inside of the support unit 270 from outside thereof. Below a description will be particularly given of the difference from the masking jig 100 of the first embodiment. The components with the shapes and functions common to the masking jig 100 of the first embodiment and the masking jig 200 of the second embodiment are denoted by the same reference numerals, and detailed description thereof will be omitted.

The masking jig 200 of the second embodiment includes the prevention unit 110 and the support unit 270. The prevention unit 110 prevents the metal ion Mi from moving toward the male thread 10*e* on the lower shaft part 10*c* of the piston rod 10. The support unit 270 supports the prevention unit 110.

The support unit 270 includes the base 280 on which the prevention unit 110 rests. The base 280 includes a cylindrical part 282 and the blocking part 283 at the bottom of the cylindrical part 282. The blocking part 283 blocks the metal ion Mi from moving toward the male thread 10*e* of the piston rod 10.

The blocking part 283 is a disk-like part closing the lower opening of the cylindrical part 282.

For example, the blocking part 283 is adhered, tacked or welded to the lower end of the cylindrical part 282. Alternatively, the blocking part 283 may be interference-fitted to the inside of the cylindrical part 282. Still alternatively, the cylindrical part 282 and the blocking part 283 may be integrally formed; in other words, the base 280 may have a cup shape.

In the masking jig 200 of the second embodiment, the cylindrical part 282 and the blocking part 283 of the base 280 of the support unit 270 surround the male thread 10*e*. This more reliably prevents the metal ion Mi from moving toward the male thread 10*e*, as compared to when the blocking part 283 is not provided. In other words, the masking jig 200 of the second embodiment more reliably prevents plating on the to-be-masked part.

Third Embodiment

Figure 9A:
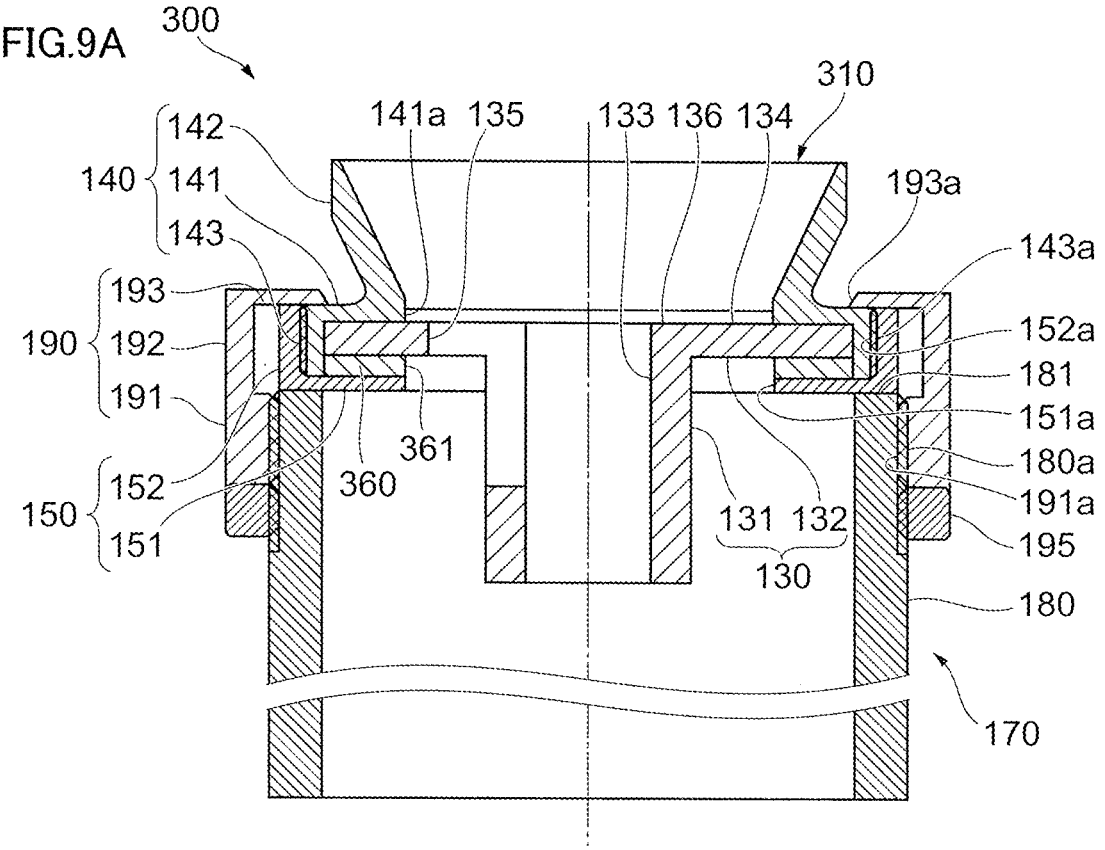
FIG. 9A depicts a schematic configuration of a masking jig of the third embodiment.
Figure 9B:
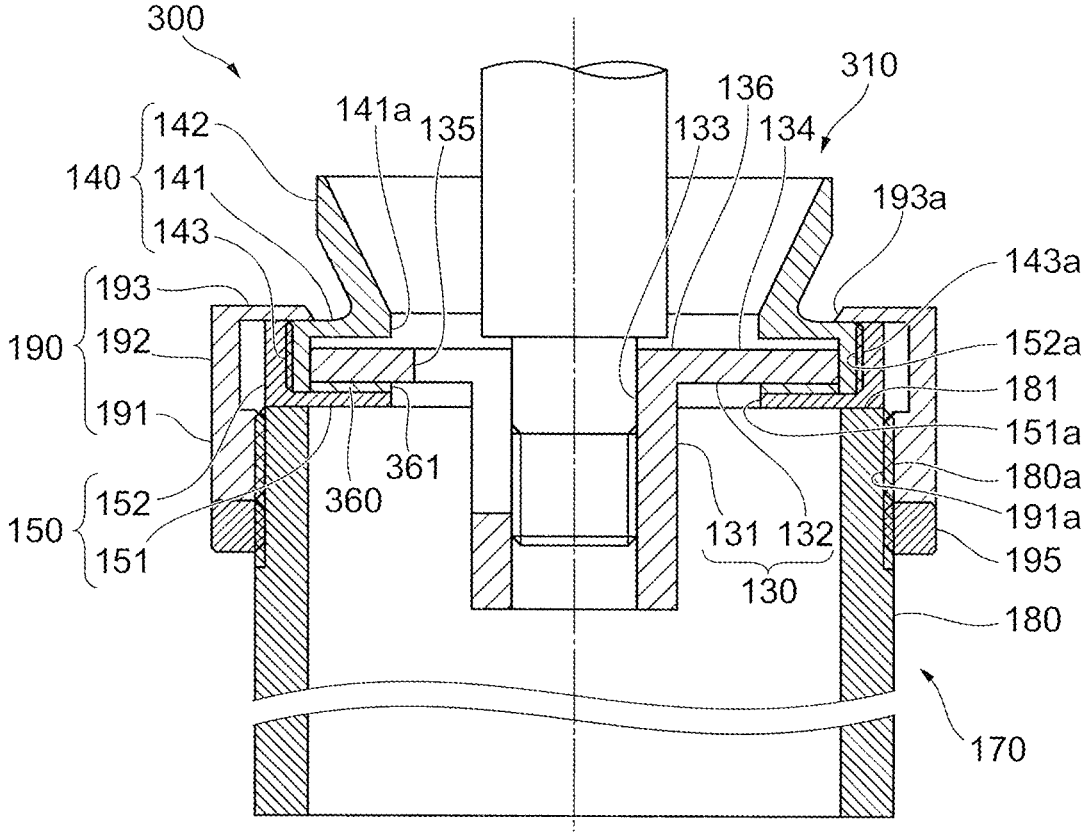
FIG. 9B depicts the masking jig 300 of the third embodiment when the piston rod 10 is inserted in it.

FIG. 9A depicts a schematic configuration of a masking jig 300 of the third embodiment. FIG. 9B depicts the masking jig 300 of the third embodiment when the piston rod 10 is inserted in it.

The masking jig 300 of the third embodiment is different from the masking jig 100 of the first embodiment in regard to the prevention unit 110. Below a description will be particularly given of the difference from the masking jig 100 of the first embodiment. The components with the shapes and functions common to the masking jig 100 of the first embodiment and the masking jig 300 of the third embodiment are denoted by the same reference numerals, and detailed description thereof will be omitted.

The masking jig 300 of the third embodiment includes a prevention unit 310 and the support unit 170. The prevention unit 310 prevents the metal ion Mi from moving toward the male thread 10*e* on the lower shaft part 10*c* of the piston rod 10. The support unit 170 supports the prevention unit 310.

Besides the contact member 130, the prevention member 140 and the holding member 150 included in the prevention unit 110 of the first embodiment, the prevention unit 310 includes an elastic member 360 that allows the contact member 130 to move in the axial direction. The elastic member 360 is positioned between the flange 132 of the contact member 130 and the disk part 151 of the holding member 150.

For example, the elastic member 360 may be a round and planar member molded of rubber and including a through-hole 361 at the center thereof. Alternatively, the elastic member 360 may be a coil spring.

The masking jig 300 of the third embodiment can have an axial displacement of the piston rod 10 absorbed by the prevention unit 310 more effectively than the masking jig 100 of the first embodiment. More specifically, for example even when an axial position of the piston rod 10 held by the holding mechanism 20 is below a standard position (e.g., the position shown in FIG. 5), the elastic member 360 is elastically deformed to allow the contact member 130 to move downward. This prevents damage to the deformation part 134 of the contact member 130 due to contact of the lower end face of the central shaft part 10*a* with the contact member 130, helping to improve durability.

Fourth Embodiment

Figure 10A:
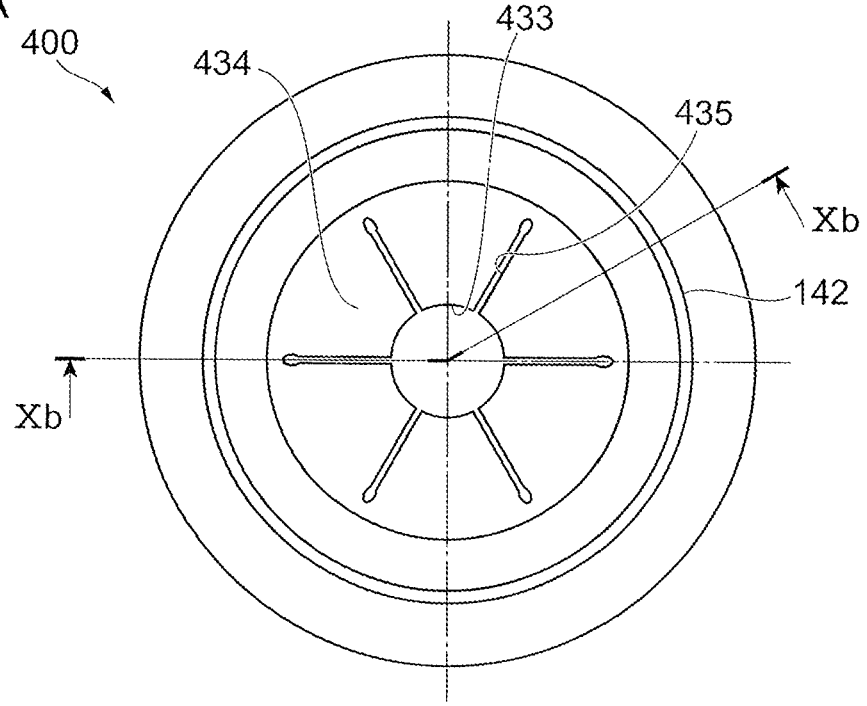
FIGS. 10A and 10B depict a schematic configuration of a masking jig of the fourth embodiment.
Figure 10B:
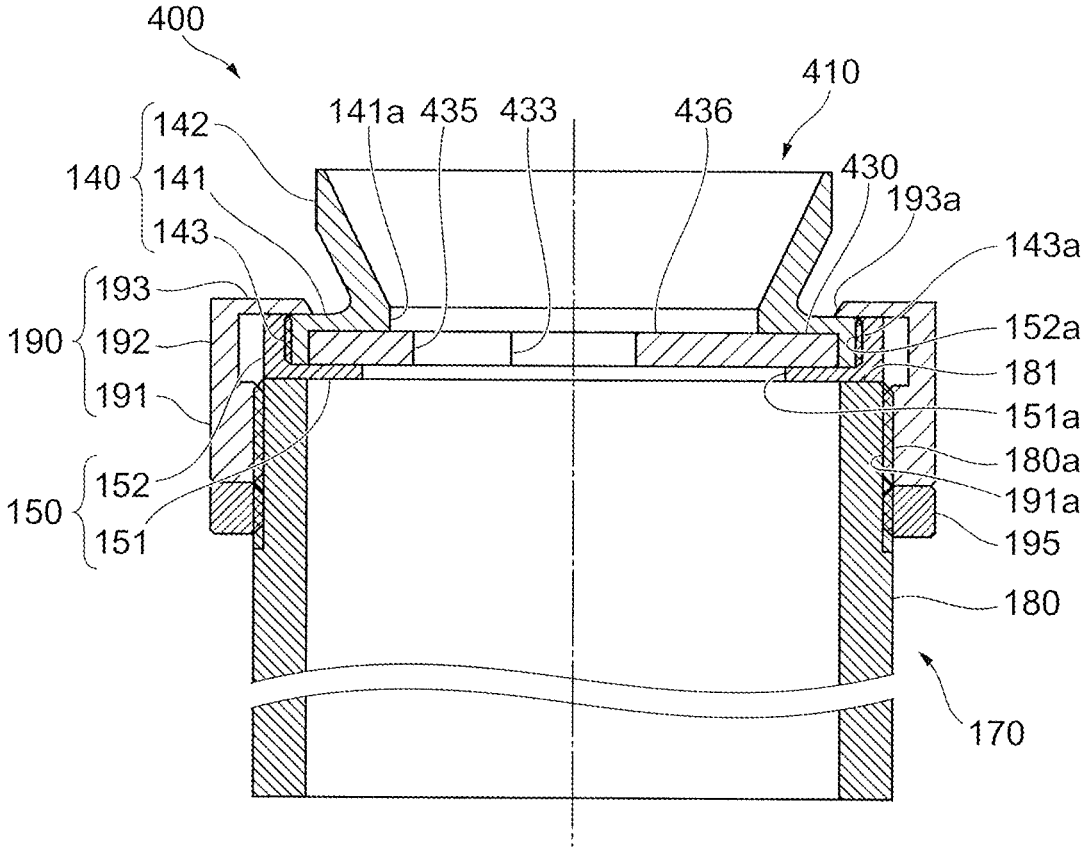

FIGS. 10A and 10B depict a schematic configuration of a masking jig 400 of the fourth embodiment.

The masking jig 400 of the fourth embodiment is different from the masking jig 100 of the first embodiment in regard to the shape of the contact member 130 of the prevention unit 110. Below a description will be particularly given of the difference from the masking jig 100 of the first embodiment. The components with the shapes and functions common to the masking jig 100 of the first embodiment and the masking jig 400 of the fourth embodiment are denoted by the same reference numerals, and detailed description thereof will be omitted.

The masking jig 400 of the fourth embodiment includes a prevention unit 410 and the support unit 170. The prevention unit 410 prevents the metal ion Mi from moving toward the male thread 10*e* on the lower shaft part 10*c* of the piston rod 10. The support unit 170 supports the prevention unit 410.

The prevention unit 410 includes a contact member 430 that contacts the outer surface of the lower shaft part 10*c* of the piston rod 10 to prevent the metal ion Mi from moving toward the male thread 10*e*. The contact member 430 is a round and planar member including a through-hole 433 at the center thereof. In other words, the contact member 430 of the fourth embodiment does not surround the male thread 10*e* of the piston rod 10, unlike the contact member 130 of the first embodiment. Around the through-hole 433, the contact member 430 includes a deformation part 434 elastically deformed by insertion of the male thread 10*e* into the through-hole 433 and contacting the outer surface of the piston rod 10. The deformation part 434 includes radial slits 435 dividing the deformation part 434 into multiple sections. That is, the contact member 430 includes multiple separate contact pieces 436, and the slits 435 are formed so that the contact pieces 436 do not contact each other in a state where the lower shaft part 10*c* of the piston rod 10 is not inserted.

For example, the contact member 430 is made of resin, such as polyvinylidene fluoride (PVDF), or metal.

Compared to the masking jig 100 of the first embodiment, the masking jig 400 of the fourth embodiment may let the metal ion Mi more easily move toward the male thread 10*e* from below the male thread 10*e* of the piston rod 10. However, as long as the base 180 has a sufficient axial length below the male thread 10*e*, it can be ensured that the metal ion Mi does not reach the male thread 10*e*. Thus, use of the prevention unit 410, which is not provided with the part to surround the male thread 10*e* of the piston rod 10, allows to simplify the shape of the masking jig, like the masking jig 400 of the forth embodiment.

The contact member 430 may consist of multiple round and planar members stacked in the axial direction. In other words, the contact member 430 may consist of multiple layers stacked in the axial direction.

Also, the elastic member 360 of the third embodiment may be placed between the contact member 430 and the disk part 151 of the holding member 150.

Fifth Embodiment

Figure 11:
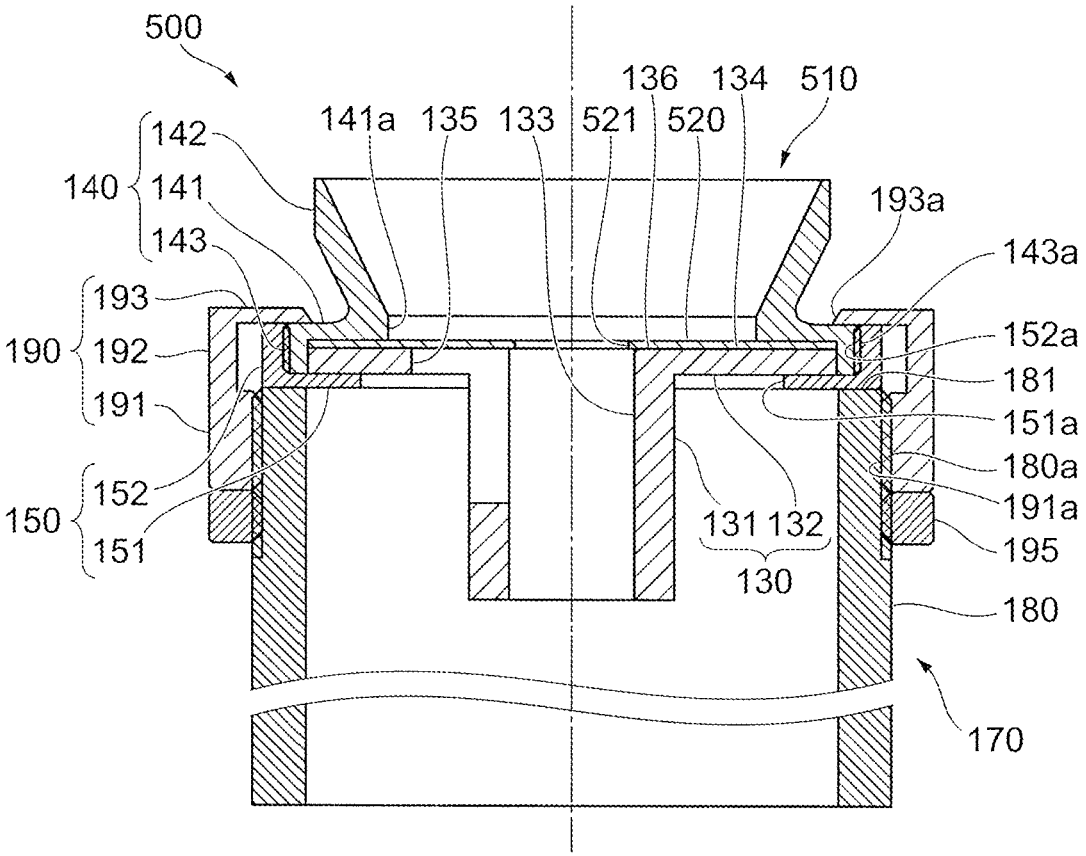
FIG. 11 depicts a schematic configuration of a masking jig of the fifth embodiment.

FIG. 11 depicts a schematic configuration of a masking jig 500 of the fifth embodiment.

The masking jig 500 of the fifth embodiment is different from the masking jig 100 of the first embodiment in regard to the prevention unit 110. Below a description will be particularly given of the difference from the masking jig 100 of the first embodiment. The components with the shapes and functions common to the masking jig 100 of the first embodiment and the masking jig 500 of the fifth embodiment are denoted by the same reference numerals, and detailed description thereof will be omitted.

The masking jig 500 of the fifth embodiment includes a prevention unit 510 and the support unit 170. The prevention unit 510 prevents the metal ion Mi from moving toward the male thread 10*e* on the lower shaft part 10*c* of the piston rod 10. The support unit 170 supports the prevention unit 510.

Besides the contact member 130, the prevention member 140 and the holding member 150 included in the prevention unit 110 of the first embodiment, the prevention unit 510 includes a blocking member 520 above the contact member 130.

The blocking member 520 is a round and planer member including a through-hole 521 at the center thereof. The hole diameter of the through-hole 521 is smaller than the outer diameter of the lower shaft part 10*c* of the piston rod 10. The blocking member 520 is an elastic body, such as rubber. For example, the blocking member 520 is molded of thermoplastic fluoropolymer, such as polyvinylidene fluoride (PVDF).

In the masking jig 500 of the fifth embodiment, the hole diameter of the through-hole 521 of the blocking member 520 is smaller than the outer diameter of the lower shaft part 10*c* of the piston rod 10. This means that the blocking member 520 contacts the outer surface of the lower shaft part 10*c* of the piston rod 10 when the lower shaft part 10*c* of the piston rod 10 is inserted in the through-hole 521. The blocking member 520 thus blocks the metal ion Mi from moving toward the male thread 10*e* from above the blocking member 520. This more reliably prevents formation of a metal thin film (reductive deposition of metal) on the male thread 10*e* of the piston rod 10.

REFERENCE SIGNS LIST

1 Electroplating apparatus
10 Piston rod
10*c* Lower shaft part
10*e* Male thread
100, 200, 300, 400, 500 Masking jig
110, 310, 410, 510 Prevention unit
130 Contact member
140 Prevention member
150 Holding member
170, 270 Support unit
180, 280 Base
190 Restricting member
195 Lock nut

The invention claimed is:

1. A masking jig comprising:

a prevention unit including a contact member, the contact member including a through-hole and a deformation part around the through-hole, the through-hole allowing for insertion of a rod-like member to be plated, the deformation part being configured to get elastically deformed by insertion of a specific portion of the member to be plated into the through-hole and contact an outer peripheral end face of the member to be plated, the prevention unit being configured to prevent a plating substance from moving toward the specific portion; and a support part configured to support the prevention unit such that the prevention unit moves in a direction intersecting an axial direction of the member to be plated, wherein the support part includes a base and a restricting member, the base allowing the contact member to rest thereon, the restricting member holding the prevention unit between the base and the restricting member to thereby restrict the prevention unit from moving in the axial direction, and the support part has a gap between an inner surface of the restricting member and an outer surface of the prevention unit, the gap allowing the prevention unit to move relative to the base in the direction intersecting the axial direction until the outer surface of the prevention unit contacts the inner surface of the restricting member.

2. The masking jig according to claim 1, wherein the deformation part includes radial slits, the radial slits dividing the deformation part into a plurality of sections.

3. The masking jig according to claim 2, wherein the contact member is an elastic body, and the contact member is formed of a plurality of layers stacked in the axial direction of the member to be plated.

4. The masking jig according to claim 3, wherein the prevention unit further includes a prevention member configured to prevent a plating substance from moving toward the specific portion.

5. The masking jig according to claim 2, wherein the prevention unit further includes a prevention member configured to prevent a plating substance from moving toward the specific portion.

6. The masking jig according to claim 5, wherein the prevention member includes an inclined part, the inclined part being inclined relative to the axial direction of the member to be plated such that a gap between the inclined part and a given portion of the member to be plated gradually narrows toward the contact member, and an inclination angle of the inclined part relative to the axial direction is less than 45 degrees.

7. The masking jig according to claim 6, wherein the inclined part of the prevention member is smaller in size in the direction intersecting the axial direction than the base.

8. The masking jig according to claim 7, wherein the base includes a blocking part configured to block the plating substance from moving toward the specific portion.

9. The masking jig according to claim 8, wherein the prevention member includes an inclined part, the inclined part being inclined relative to the axial direction of the member to be plated such that a gap between the inclined part and a given portion of the member to be plated gradually narrows toward the contact member, and an inclination angle of the inclined part relative to the axial direction is less than 45 degrees.

10. The masking jig according to claim 9, wherein the base includes a blocking part configured to block the plating substance from moving toward the specific portion.

11. The masking jig according to claim 6, wherein the base includes a blocking part configured to block the plating substance from moving toward the specific portion.

12. The masking jig according to claim 1, wherein the contact member is an elastic body, and the contact member is formed of a plurality of layers stacked in the axial direction of the member to be plated.

13. The masking jig according to claim 12, wherein the prevention unit further includes a prevention member configured to prevent a plating substance from moving toward the specific portion.

14. The masking jig according to claim 13, wherein the inclined part of the prevention member is smaller in size in the direction intersecting the axial direction than the base.

15. The masking jig according to claim 1, wherein the prevention unit further includes a prevention member configured to prevent a plating substance from moving toward the specific portion.

16. The masking jig according to claim 15, wherein the prevention member includes an inclined part, the inclined part being inclined relative to the axial direction of the member to be plated such that a gap between the inclined part and a given portion of the member to be plated gradually narrows toward the contact member, and an inclination angle of the inclined part relative to the axial direction is less than 45 degrees.

17. The masking jig according to claim 16, wherein the inclined part of the prevention member is smaller in size in the direction intersecting the axial direction than the base.

18. The masking jig according to claim 17, wherein the base includes a blocking part configured to block the plating substance from moving toward the specific portion.

19. The masking jig according to claim 16, wherein the base includes a blocking part configured to block the plating substance from moving toward the specific portion.

20. An electroplating apparatus comprising:

a plating tank storing a plating solution containing a plating substance;

a holding part configured to hold a rod-like member to be plated; and a masking jig placed within the plating tank, the masking jig being configured to mask a specific portion of the member to be plated, wherein the masking jig includes:

a prevention unit including a contact member, the contact member including a through-hole and a deformation part around the through-hole, the through-hole allowing for insertion of the member to be plated, the deformation part being configured to get elastically deformed by insertion of the specific portion into the through-hole and contact an outer peripheral end face of the member to be plated, the prevention unit being configured to prevent a plating substance from moving toward the specific portion; and a support part configured to support the prevention unit such that the prevention unit moves in a direction intersecting an axial direction of the member to be plated, the support part includes a base and a restricting member, the base allowing the contact member to rest thereon, the restricting member holding the prevention unit between the base and the restricting member to thereby restrict the prevention unit from moving in the axial direction, and the support part has a gap between an inner surface of the restricting member and an outer surface of the prevention unit, the gap allowing the prevention unit to move relative to the base in the direction intersecting the axial direction until the outer surface of the prevention unit contacts the inner surface of the restricting member.

* * * * *